US005214885A

United States Patent [19]

Maas et al.

[11] Patent Number: 5,214,885

[45] Date of Patent: * Jun. 1, 1993

[54] PORTABLE ROOM DIVIDER

[76] Inventors: John C. Maas; Paul Maas, both of 1387 Woodland La., Deerfield, Ill. 60015

[ * ] Notice: The portion of the term of this patent subsequent to Jun. 12, 2007 has been disclaimed.

[21] Appl. No.: 496,553

[22] Filed: Mar. 20, 1990

Related U.S. Application Data

[63] Continuation-in-part of Ser. No. 336,267, Apr. 11, 1989.

[51] Int. Cl.[5] ..... E04B 1/344

[52] U.S. Cl. ..... 52/71; 52/239

[58] Field of Search ..... 52/239, 71, 32, 29; 312/297

[56] References Cited

U.S. PATENT DOCUMENTS

| | | | |
|---|---|---|---|
| 756,091 | 3/1904 | Alpick | 312/297 |
| 1,410,225 | 3/1922 | Seaman . | |
| 1,731,327 | 10/1929 | Terrisse . | |
| 2,162,523 | 6/1939 | Blood et al. . | |
| 3,060,521 | 10/1962 | Greco | 52/71 |
| 3,330,611 | 7/1967 | Heifetz . | |
| 3,387,413 | 6/1968 | Huey | 52/71 |
| 3,402,515 | 9/1968 | Rainaut . | |
| 3,534,512 | 10/1970 | Ballas | 52/71 |
| 3,629,982 | 12/1971 | Ballay . | |
| 3,866,365 | 2/1975 | Honigman | 52/71 |
| 4,161,850 | 7/1979 | Peterson et al. . | |
| 4,192,106 | 3/1980 | Hell . | |
| 4,569,163 | 2/1986 | Long . | |

*Primary Examiner*—Michael Safavi
*Attorney, Agent, or Firm*—Quarles & Brady

[57] ABSTRACT

A combination cabinet-room divider includes at least one storage compartment which contains a plurality of folded wall panels. The panels can be removed and unfolded to form a wall that is anchored at one end to the cabinet. In a preferred embodiment, the cabinet-room divider has two storage compartments and two sets of wall panels.

7 Claims, 8 Drawing Sheets

FIG. 4
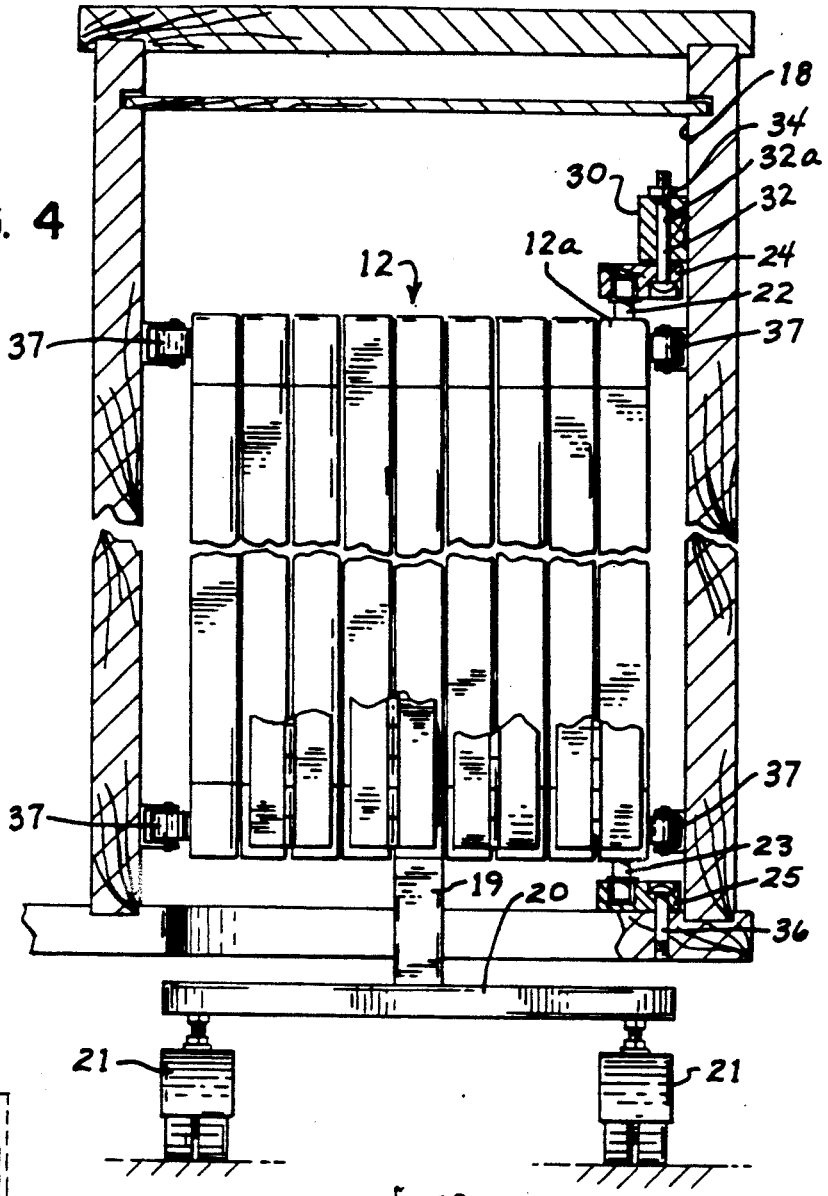
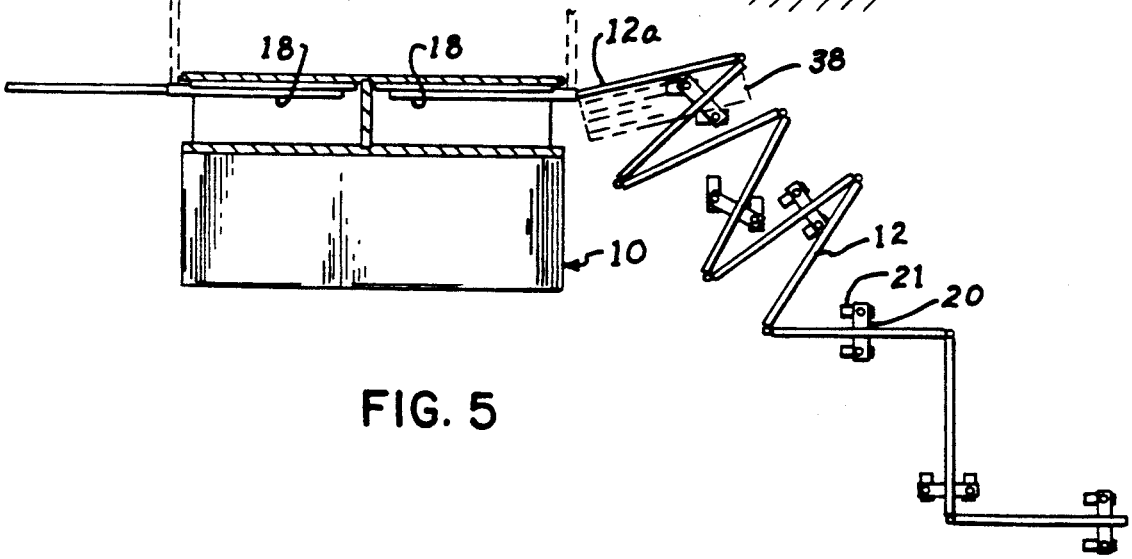
FIG. 5

FIG. 7
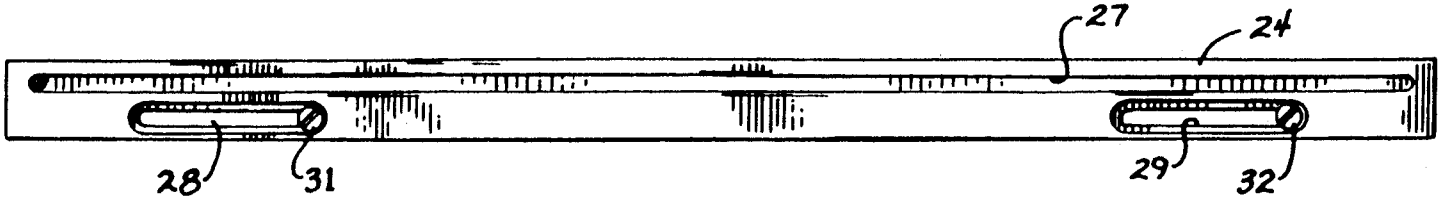
FIG. 8
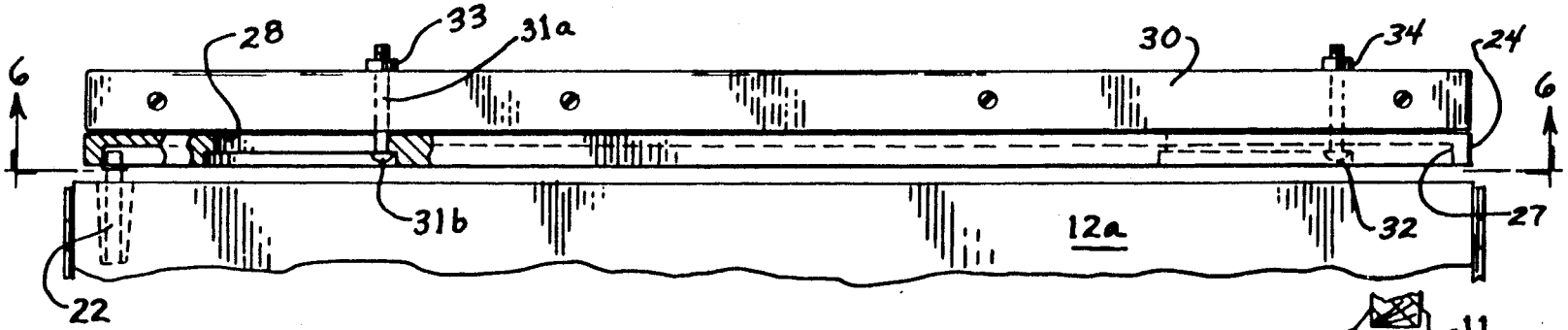
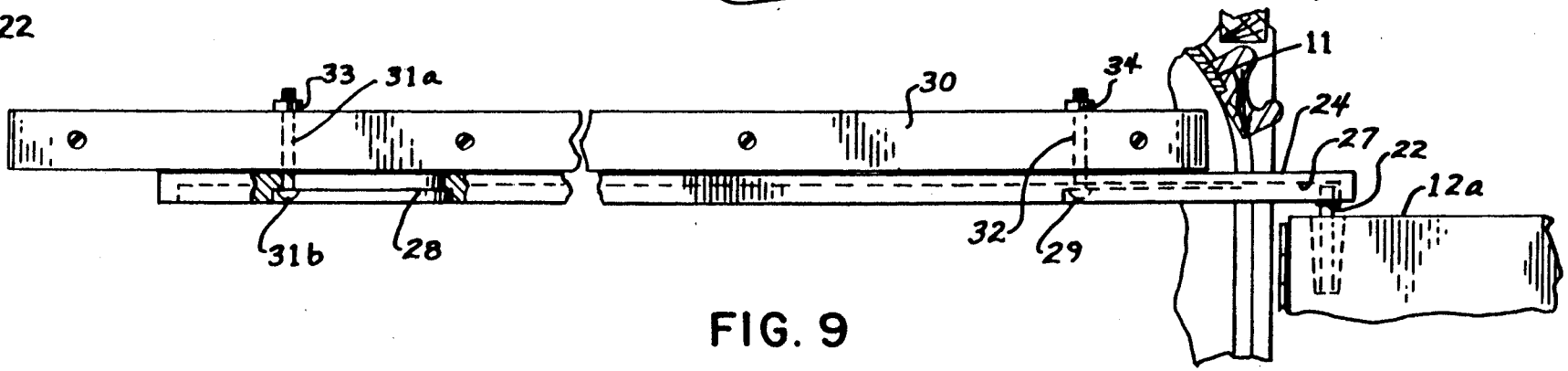
FIG. 9

FIG. 12
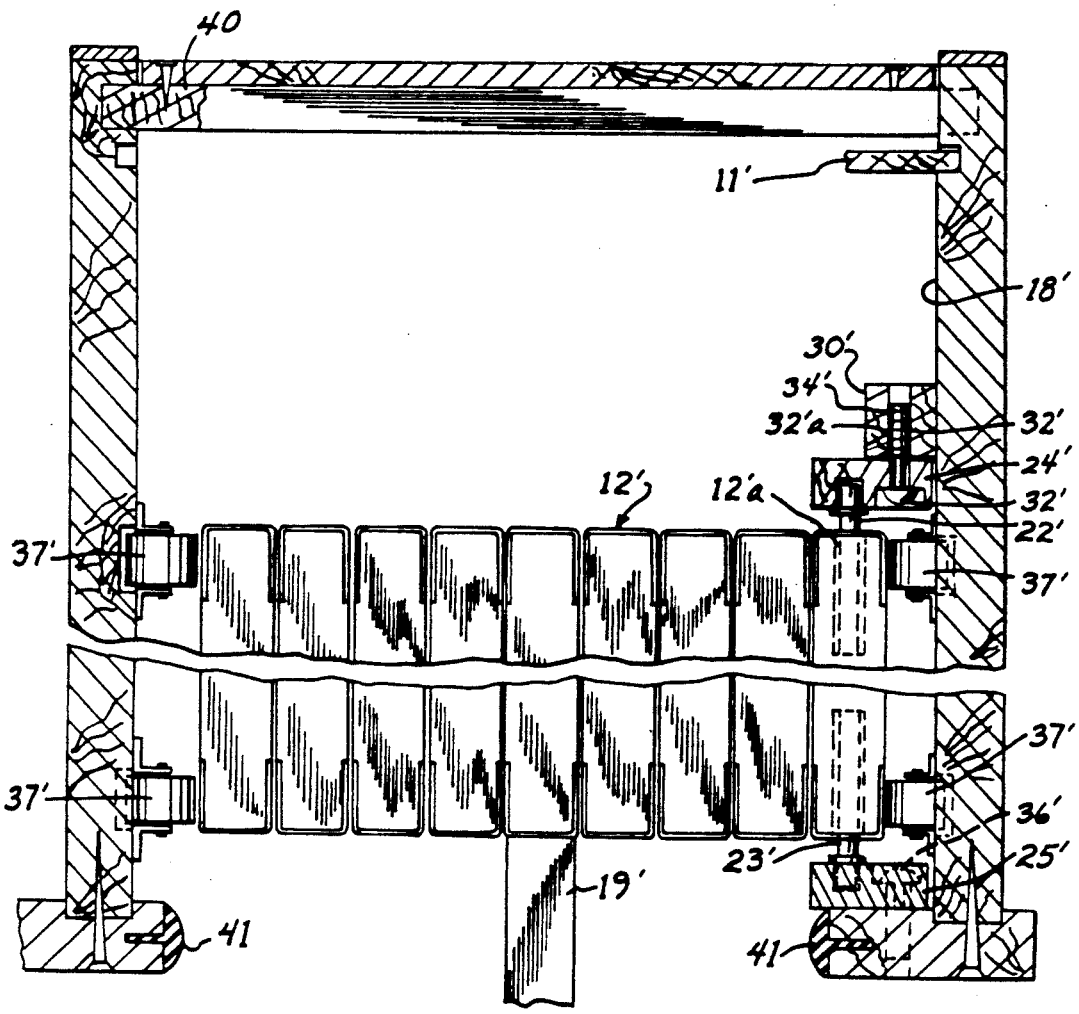
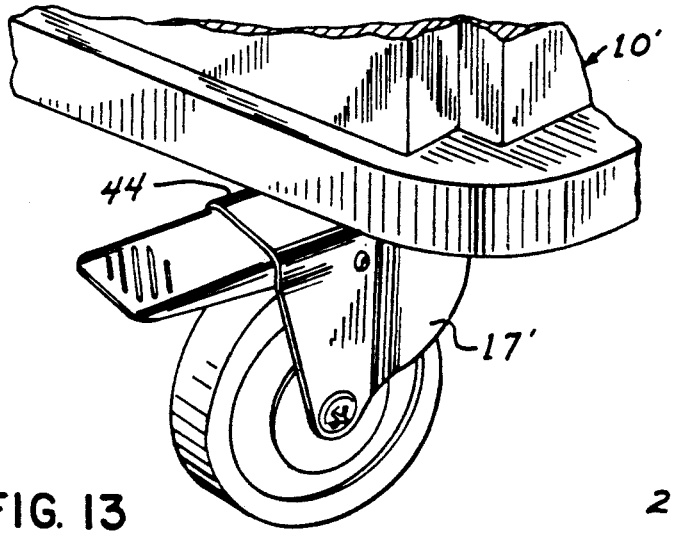
FIG. 13
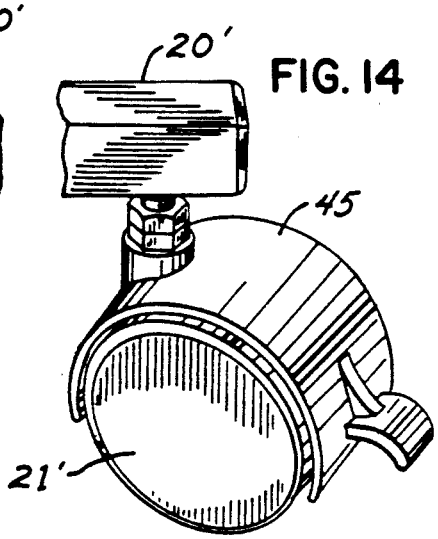
FIG. 14

PORTABLE ROOM DIVIDER

CROSS REFERENCE TO RELATED APPLICATION

This is a continuation-in-part of Ser. No. 07/336,267 filed Apr. 11, 1989.

FIELD OF THE INVENTION

The present invention relates generally to room dividers, more particularly, it relates to a portable combination cabinet-room divider.

BACKGROUND OF THE INVENTION

There are times that it is desired to divide large areas, such as rooms or halls, into smaller more private areas. One method of doing this is by the use of movable wall panels which are suspended from and move on tracks attached to the ceiling and/or floor. This method is relatively expensive and it is inflexible.

Another method of dividing large areas into smaller private areas is to use movable free standing wall units. This method is relatively inexpensive and it permits the formation of areas of a wide variety of shapes, but the free standing wall units present storage and handling problems.

There is a need for portable apparatus for dividing large areas into a wide variety of different shaped smaller and more private areas which does not present storage and handling problems.

BRIEF SUMMARY OF THE INVENTION

It is an object of the present invention to disclose an inexpensive, apparatus for dividing large areas into smaller private areas.

It is a further object to disclose such an apparatus which does not present the storage and handling problems of prior art free standing wall units.

The apparatus of the present invention comprises a portable cabinet with an enclosed hollow interior which contains a plurality of folded wall panels which can be removed and unfolded to form a wall. One end of one of the wall panels is anchored to the cabinet and the other end is attached by a hinge to a second wall panel. Additional wall panels are hingedly connected together in a similar manner to form a wall of the desired length.

In one preferred embodiment the cabinet is mounted on casters and in another it is adapted to be hung on a wall. In both preferred embodiments a storage compartment in the hollow interior of the cabinet is closed by a door that can be opened t permit the removal and return of the folded wall panels.

It will be apparent to those skilled in the art from the description that follows that the aforementioned and other objects can be achieved by the apparatus of the present invention.

BRIEF DESCRIPTION OF THE DRAWINGS

In the drawings:

FIG. 2 is a perspective view of the cabinet of FIG. 1 with the doors open and the wall panels unfolded;

FIG. 4 is an enlarged sectional view taken along lines 4—4 in FIG. 3;

FIG. 5 is a partial top view, partly in section, of the embodiment of FIG. 2;

FIGS. 7 to 9 are views showing the mechanism which anchors a panel to the cabinet;

FIGS. 10, 11, and 12 are views similar to FIGS. 2, 3 and 4, respectively, showing alternative embodiments;

FIGS. 13 and 14 are enlarged perspective views showing casters with brakes mounted on the cabinet and a panel.

DESCRIPTION OF A PREFERRED EMBODIMENT

Figure 1:
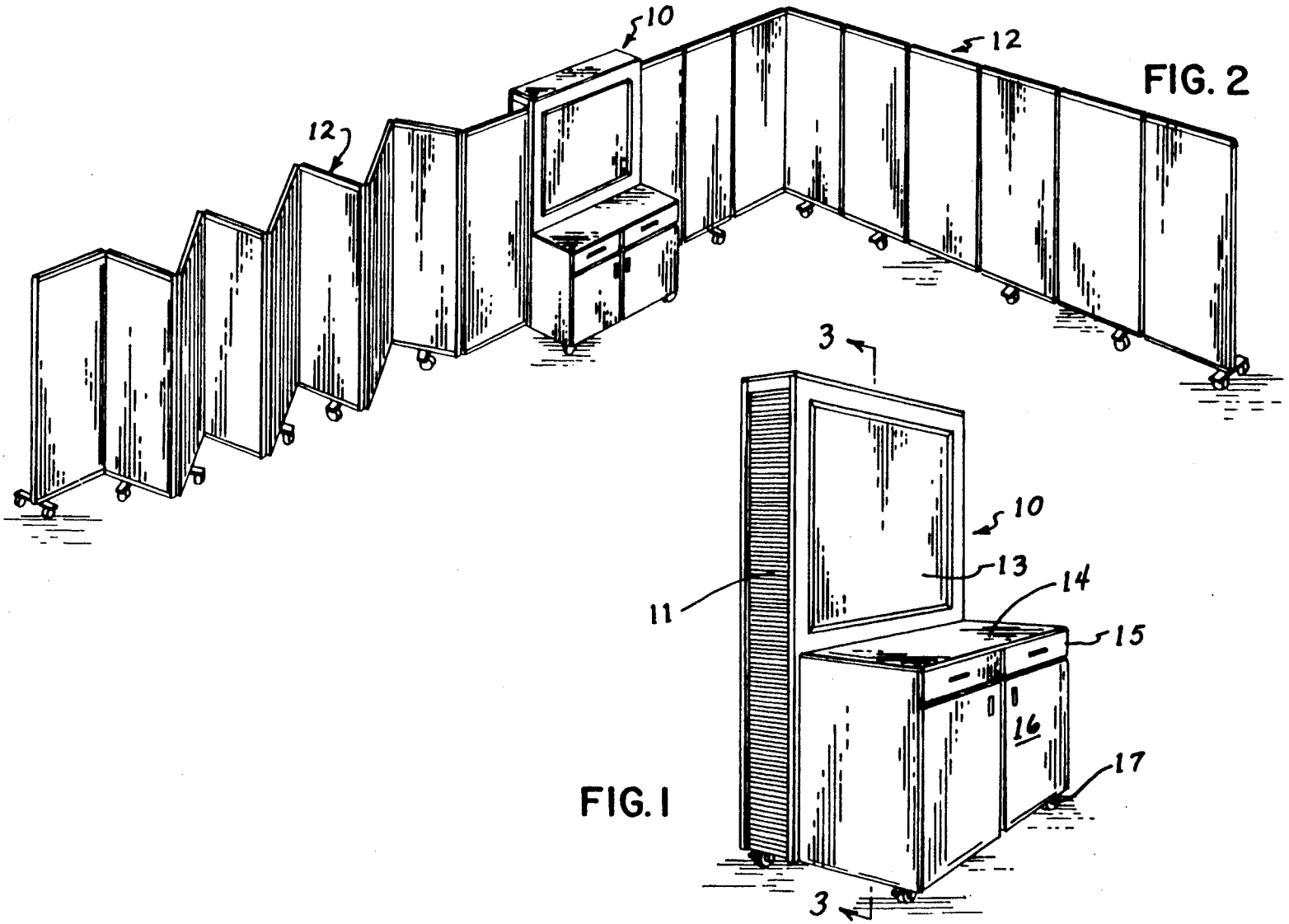
FIG. 1 is a perspective view of the embodiment of the cabinet of the present invention having casters.

In the drawings FIGS. 1 and 2 show a cabinet-room divider 10 of the present invention. In FIG. 1 the cabinet-room divider 10 is shown prior to use as a room-divider and in FIG. 2 it is shown in use with the doors 11 open and the wall panels 12, which are normally stored therein, unfolded. In FIG. 1 only one of the doors 11 can be seen, but there are two such doors one at each end of the cabinet-room divider 10.

Still referring to FIGS. 1 and 2, it can be seen that the cabinet-room divider 10 has both a vertical work surface 13 and a horizontal work surface 14. It also has storage drawers 15 and doors 16 that close off parts of the cabinet interior below the horizontal work surface 14. The cabinet-room divider 10 is mounted on all-directional casters 17 so it is portable and can be easily moved from one location to another.

Figure 3:
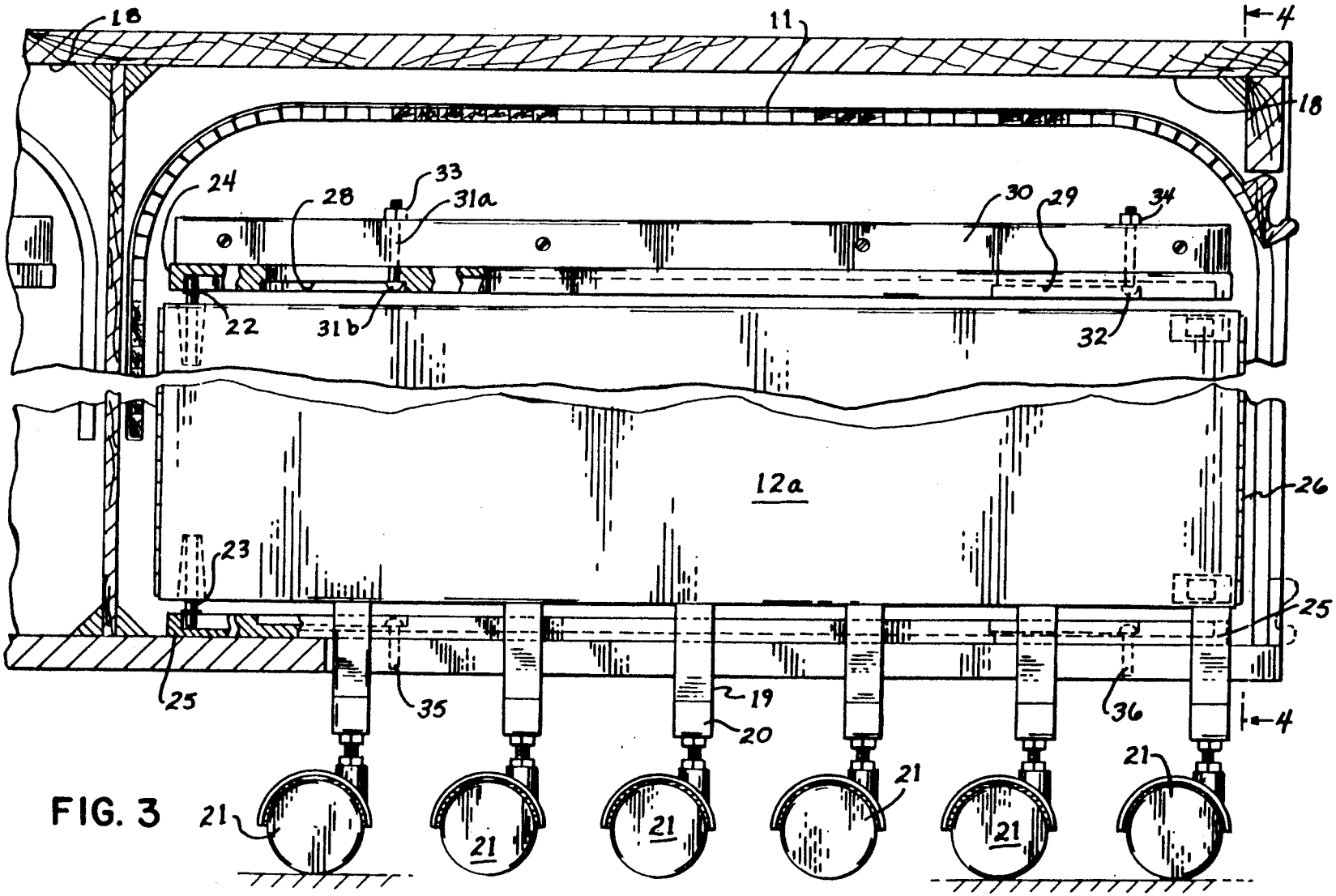
FIG. 3 is an enlarged, sectional partial view of one of the storage compartments of the cabinet of FIG. 1 taken along lines 3—3.
Figure 6:
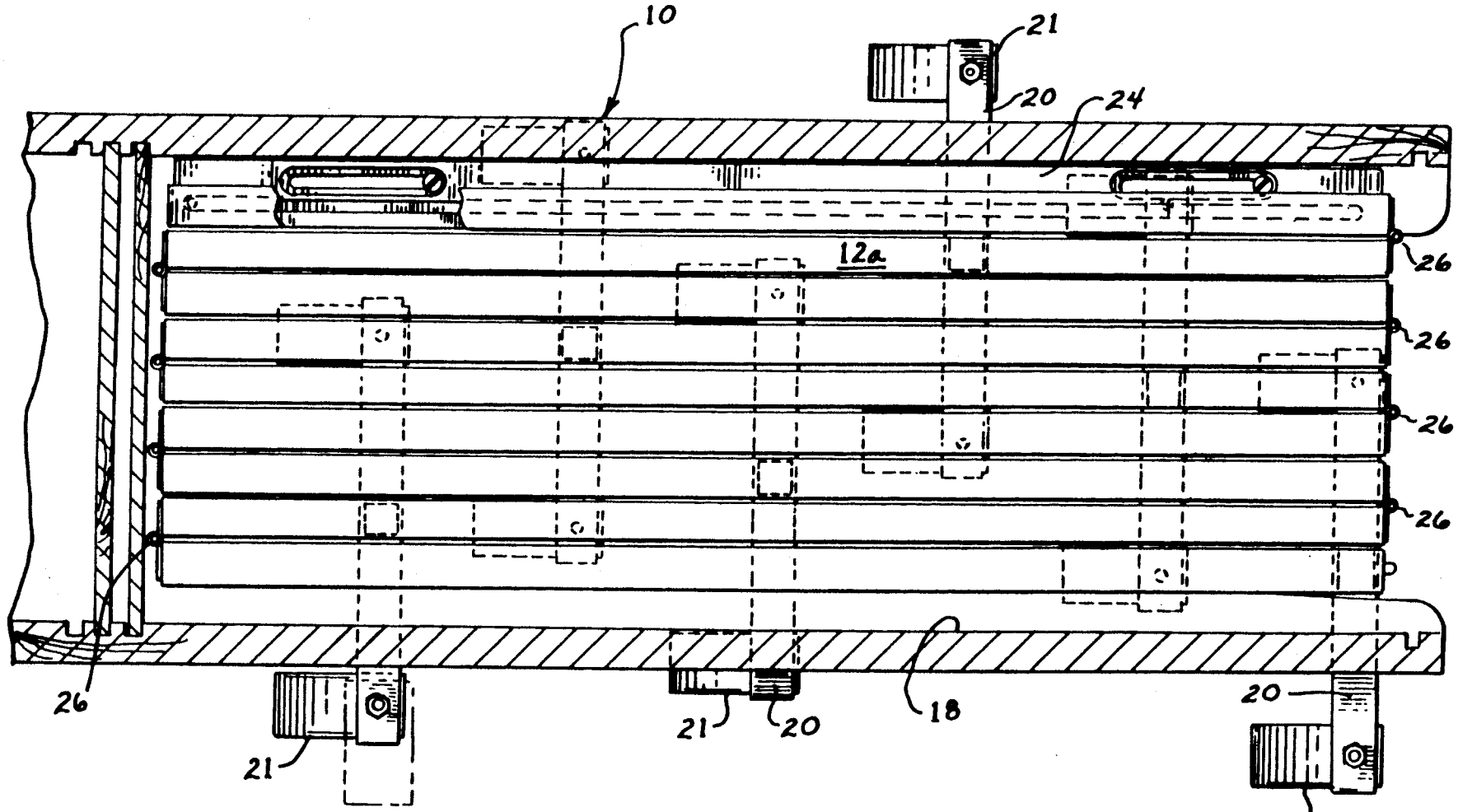
FIG. 6 is a top view of the storage compartment of FIG. 3.

In FIGS. 3, 4 and 6, the cabinet-room divider 10 is shown with wall panels 12 stored within one of two panel storage compartments 18 in the hollow interior of the cabinet-room divider 10. As seen therein, selected wall panels 12 are each provided at the bottom with a leg 19 with a foot 20 having two pair of spaced-apart floor engaging casters 21.

Still referring to FIGS. 3 and 4, it can be seen that there are anchor pins 22 and 23 which are mounted on the top and bottom, respectively of the inside end of the panel 12*a*. The pins 22 and 23 cooperate with top and bottom slides, 24 and 25, respectively, to permit the panel 12*a* to be slid out of the compartment 18 and to prevent panel 12*a* from becoming detached from the cabinet 10 when the panels 12 are removed from storage compartment 18 and unfolded as seen in FIG. 5.

Returning to FIG. 6, each of the wall panels 12 is seen to be connected to the immediately adjacent panels by hinges 26 so that they can be readily unfolded or folded to form integral walls as seen in FIGS. 2 and 5, respectively.

In FIGS. 7, 8 and 9 the top slide 24 and its relationship with the panel 12*a*, the pin 22 and the compartment 18 is illustrated. As seen best in FIG. 7, the slide 24 is an elongated member, preferably of a self-lubricating plastic, which has a track 27 for the pin 22 and a slot 28, 29 at each end.

As seen in FIGS. 3, 4 and 8, the slide 24 is secured to a bracket 30 on one wall of the compartment 18 by a pair of bolts 31, 32 and nuts 33, 34. The bolt 31 has a shank 31*a* which extends through and is narrower than the slot 28 and an enlarged head 31*b* which is wider than the slot 28. The other end of the slide 24 is secured to the bracket 30 in a similar manner with the bolt 32 and nut 34. When the panel 12*a* is stored as seen in FIG. 8 the bolts 31, 32 are at the far right end of the slots 28 and 29 and when the panel 12*a* is fully extended (as seen in FIG. 9) the bolts 31, 32 are at the innermost other end of the slots 28 and 29 and the pin 22 is at the outermost end of the track 27. The bottom slide 25 seen in FIG. 3 is identical to top slide 24 and it is attached to the bottom of the compartment 18 with bolts 35, 36.

Finally, in FIG. 4, it can be seen that the wall panels 12 are stabilized in the compartment 18 by rollers 37 which are mounted on the side walls of the compartment 18.

In use the cabinet-room divider 10 with the folding wall panels 12 stored and the doors 11 closed as seen in FIG. 1 can be readily moved into an area to be divided. The cabinet-room divider 10 is positioned where desired to divide the area into one or more predetermined private areas. The casters 17 are then locked in place with caster brakes as described later in conjunction with FIG. 13. The doors 11 are raised, and the hinged, folded wall panels 12 removed from the storage compartment 18 as a stack 38 as seen in dotted lines in FIG. 5. The movement of the panels 12 from the storage compartment 18 is controlled and stopped by the cooperation of panel 12*a*, pins 22, 23 and the slides 24, 25. The withdrawal of the panels 12 as a stack 38 is facilitated by the casters 21 on the feet 20 of the selected wall panels 12 and the rollers 37. The wall panels 12 can be then unfolded as seen on the right in FIG. 5 and arranged to form a wall as seen in FIG. 2. If desired, the casters 21 also can be provided with caster brakes to help immobilize the thus formed wall as later described in conjunction with FIG. 14.

The same procedure can be used to remove and assemble a second wall using the wall panels stored in the other panel storage compartment of the cabinet interior.

When it is desired to disassemble the walls and store the wall panels 12 in the storage compartment 18, the caster brakes, if any, on the casters 21 are unlocked and the hinged panels 12 are folded to form the stack 38 as seen in FIG. 5. The storage of the stack 38 of wall panels in the storage compartment 18 is facilitated by the cooperation of the pins 22, 23, the slides 24 and 25 and the rollers 37.

It will be apparent to those skilled in the art from the foregoing description and the drawings that the present invention provides a very convenient, inexpensive and flexible means for dividing large areas into smaller more private areas. As seen in FIG. 2, the walls that are formed can be straight angular or partially folded. The walls can be the width of a single wall panel or an multiple thereof and within limits they can extend in any direction.

Figure 10:
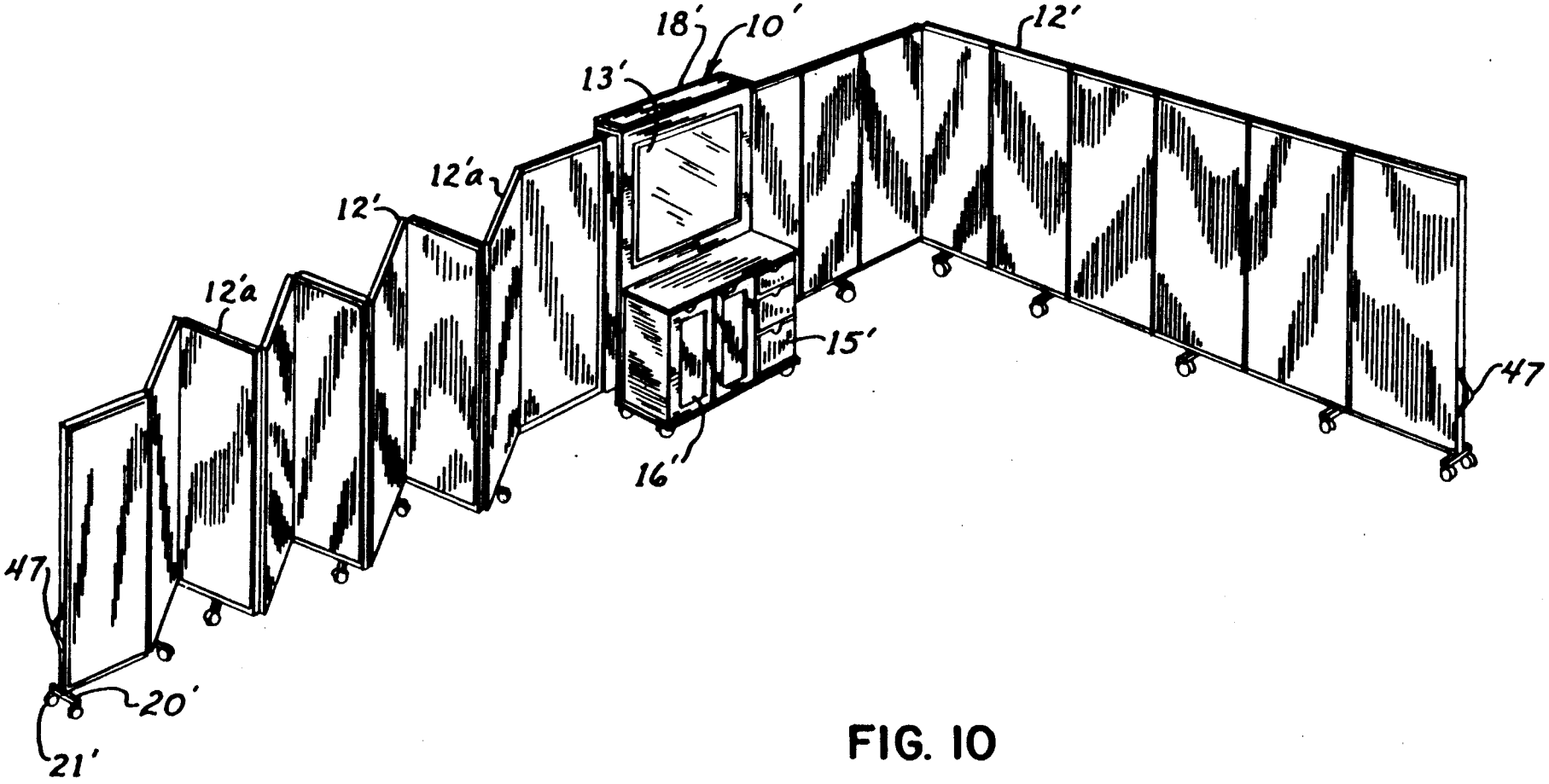

FIGS. 10–14 illustrate alternative embodiments wherein similar components are described except they are "primed." Referring to FIG. 10 it is seen that cabinet-room divider 10′ has two doors 16′ with three drawers 15′ placed laterally of the doors 16′. Unlike embodiment 10, the panel 12*a*′ which is anchored to the compartment 18′ is anchored towards the rear thereof and the remaining panels 12*a*′ are folded in a different manner. This folding provides for a symmetrical unfolding and folding with respect to each other. A pull strap handle 47 is shown on the lead panels to aid in unfolding the panels 12′ from the storage compartment 18′.

Figure 11:
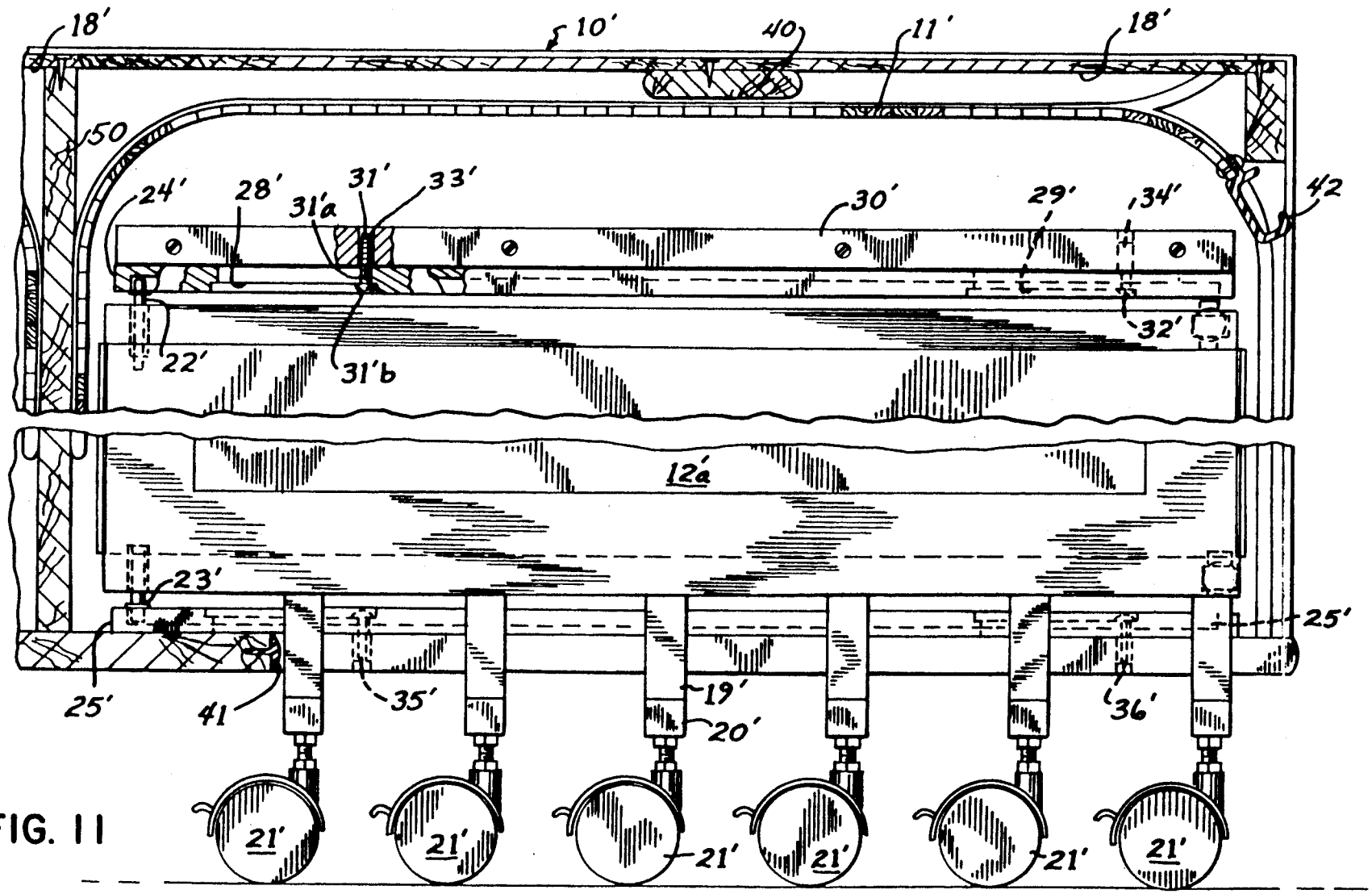

In FIGS. 11 and 12 there is shown a mid header 40 inside the cabinet-room divider 10′. This provides stability for the door track 11′ as does the center stiffner panel 50 which is increased in width over that shown in FIG. 3. Also threaded insert screws 31′, 32′, 35′ and 36′ are employed to secure the glide bars 24′ and 25′. These have a nylon patch on them (not shown) to prevent unthreading. Bumpers 41 are disposed in the base of the cabinet-room divider for protection against contact by the legs 19′. There is also illustrated a generally elongated C-shaped door handle 42 which is preferably made from nylon.

Referring to FIGS. 13 and 14, casters 17′ and 21′ are shown. Caster 17′ has a brake member 44 and similarly caster 21′ has a brake member 45.

It also will be apparent to those skilled in the art that a number of changes and modifications can be made without departing from the spirit and scope of the invention. For example, if desired the cabinet-room divider can be adapted to hang upon a wall or provided as a doubled cabinet with horizontal work surfaces on each side of the panel storage compartment. In addition, the casters and legs may take forms other than those shown and described. Therefore, it is intended that the invention not be limited except by the claims.

We claim:

1. A portable cabinet-room divider comprising:
(a) a cabinet defined by front and back walls and a door portion with an opening at the bottom to provide an enclosed panel storage compartment;
(b) a plurality of hinged wall panels in said compartment, said panels operatively positioned between said front and back walls for extension and retraction therebetween, a first of said panels being anchored at one side to the cabinet and a second of said panels being hingedly connected to the other side of the first panel so that said panels can form a wall anchored at one end by the cabinet; and
(c) caster means including at least two spaced apart casters mounted on a foot on opposing sides of at least some of said panels for positioning through said opening at said bottom of said cabinet.

2. A portable cabinet-room divider of claim 1 in which there are two storage compartments each containing a set of foldable panels.

3. A portable cabinet-room divider comprising
(a) a cabinet defined by front and back walls with an opening at the bottom to provide an enclosed panel storage compartment;
(b) a plurality of hinged wall panels in said compartment, said panels operatively positioned between said front and back walls for extension and retraction therebetween, a first of said panels being anchored at one side to the cabinet and a second of said panels being hingedly connected to the other side of the first panel so that said panels can form a wall anchored at one end by the cabinet, said hinged wall panels being freely movable in selected directions with respect to said cabinet and having portions accommodated by said opening at said bottom of said cabinet.

4. A portable cabinet-room divider of claim 3 in which at least one of the cabinet and the hinged wall panels are mounted on casters which can be locked.

5. A portable cabinet-room divider of claim 3 in which the cabinet includes door members.

6. A portable cabinet-room divider of claim 3 in which the cabinet includes drawer members.

7. A portable cabinet-room divider of claim 3 in which one of the panels provides a lead panel and has a handle for pulling the panel.

* * * * *